United States Patent [19]

Durand

[11] Patent Number: 4,528,807

[45] Date of Patent: Jul. 16, 1985

[54] PROCESS FOR THE MANUFACTURE OF A FANCY YARN, AND PRODUCTS OBTAINED

[75] Inventor: Marc Durand, Decines, France

[73] Assignee: Chavanoz S.A., Pont-de-Cherny, France

[21] Appl. No.: 505,294

[22] Filed: Jun. 17, 1983

[30] Foreign Application Priority Data

Jun. 25, 1982 [FR] France ..... 82 11339

[51] Int. Cl.[3] ..... D02G 1/02; D02G 3/34; D02G 3/38

[52] U.S. Cl. ..... 57/6; 57/12

[58] Field of Search ..... 57/3, 6, 12, 13, 14, 57/24, 206, 207, 209

[56] References Cited

U.S. PATENT DOCUMENTS 3,763,640 10/1973 Nagel et al. ..... 57/6

4,124,973 11/1978 Hense et al. ..... 57/208 X

*Primary Examiner*—Donald Watkins

*Attorney, Agent, or Firm*—Sherman & Shalloway

[57] ABSTRACT

Process for the manufacture of a fancy yarn having stable protuberances along its length, wherein at least one effect yarn is fed onto a core yarn at a greater speed than the latter, the protuberances thus produced and the core yarn being bound together by the combination of feeding of the effect yarn in an oscillating manner relative to the core yarn and increasing the twist of the assembly passing through a simple false twist device, without the need for heat setting means.

8 Claims, 4 Drawing Figures

PROCESS FOR THE MANUFACTURE OF A FANCY YARN, AND PRODUCTS OBTAINED

The present invention relates to a process for the manufacture of fancy yarns and to the products obtained.

The invention applies more particularly to a process for obtaining a fancy yarn with protuberances, such as a slub yarn, a knop yarn or the like.

These yarns are generally manufactured by combining at least two yarns, one of which, called the core yarn, is covered by the second, called the effect yarn, which is overfed in a uniform or non-uniform manner, relative to the core yarn, so as to form the desired effect, which effect is optionally stabilized by means of a third yarn, called the binding yarn.

Thus, it is known from U.S. Pat. No. 2,731,789 to obtain knop yarns by combining a core yarn and an effect yarn by means of a rotary spindle, the second yarn being overfed relative to the first; the knops obtained are only comparatively stable, however, and it is recommended to use a third yarn in order to stabilize them in a subsequent operation.

French Pat. No. 1,561,939 proposed to manufacture a fancy yarn by imparting false twist to a core yarn and an effect yarn overfed relative to the core yarn, and then binding with a binding yarn at the moment of false twist, the core yarn being fed simultaneously with the effect yarn into a false twist device, and the yarns being combined by a false twist effect during passage through the hollow spindle, the binding yarn then being introduced at the moment of blockage of the false twist.

Another principle making it possible to obtain relative cohesion of the effect yarn on the core yarn uses a false twist spindle and a setting oven, this heat setting means being located upstream of the false twist spindle; the latter principle is described, in particular, in the French Patent published under No. 2,035,611 and the French Utility Certificate published under No. 2,348,294. In these processes thus described, it is imperative to use a texturing device with a thermal means of stabilizing the effect, such as a setting oven.

According to the present invention there is provided a process for the manufacture of a fancy yarn having stable protuberances along its length, said process comprising the steps of feeding a core yarn at a first speed, feeding at least one effect yarn onto the core yarn at a speed greater than said first speed, the effect yarn being fed relative to the core yarn in an oscillating manner, feeding the resulting assembly of the core yarn and the effect yarn through a single false twist spindle to increase the twist of the assembly, the protuberances produced in the assembly being bound together by the combined action of the oscillating feed of the effect yarn and that of the false twist spindle.

There is thus provided a simple process for producing a fancy yarn with a stable effect, without the need of using heat setting means.

The core and effect yarns, taken individually or in combination, can be continuous filaments, spun yarns or slubbings, presented in crimped, textured or untextured forms and made of any material, namely natural material, regenerated cellulosic material or synthetic material, used by itself, in a mixture, in combination such as combining or twisting.

In the present invention, the false twist texturing means is used not as a texturing member but simply as a provisional or alternate twisting means.

The core yarn can be fed in a natural or forced way at a constant or non-constant speed. The effect yarn can be fed onto the core yarn, in a manner which may or may not be perpendicular relative to the latter, with a fixed or variable amplitude of oscillation.

As is known, the variations in the relative speeds of the core and effect yarns give rise to protruberances in the form of knops, longer or shorter slubs, loops, slub loops in which either the loop effect or the slub effect is dominant, and so on.

The oscillation may either be natural or caused by a means enabling the yarn in question to be given a reciprocating movement parallel to the core yarn on which it causes the effect, the amplitude of oscillation being adjustable so that this oscillation is uniform or non-uniform in length; this oscillation can be caused by any known means, for example of the yarn guide type, controlled by a device permitting the said oscillation.

In order that the present invention will more readily be understood, the following description is given, merely by way of example, reference being made to the accompanying drawings, in which.

Figure 1:
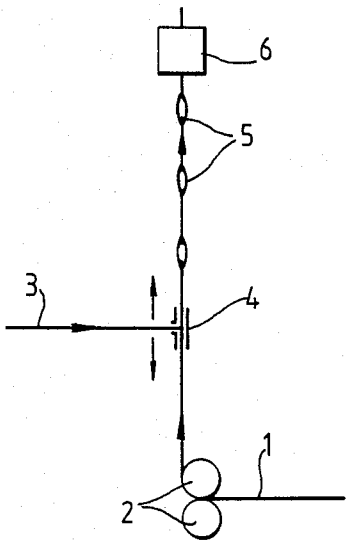
FIGS. 1 to 3 are schematic side elevations of three variants of the process for the manufacture of the yarn according to the present invention.

FIG. 1 shows a core yarn 1, delivery rollers 2, a reciprocable yarn guide 4, through which both the core yarn 2 and an effect yarn 3 pass, protuberances 5 produced in the resulting combined yarn and a false twist device 6.

Figure 2:
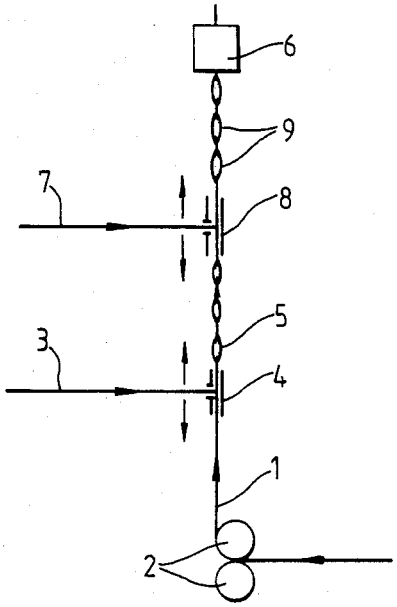

FIG. 2 shows an arrangement similar to that of FIG. 1 together with a second effect and binding yarn 7 passing through a second reciprocable yarn guide 8 and superimposed protuberances 9, which are a combination of the protuberances 5 with those caused by the second effect yarn 7.

Figure 3:
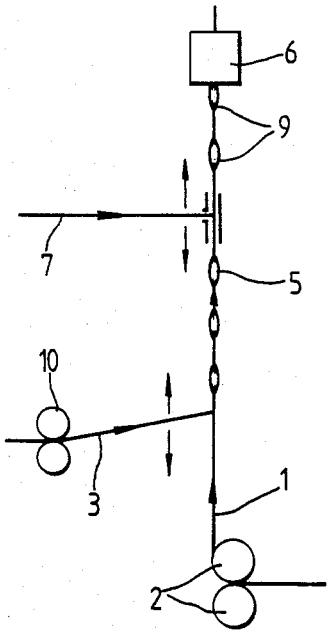

FIG. 3 shows a further arrangement similar to that of FIG. 2, except for the guide 4, the effect yarn 3, in this case coming from the controlled rollers 10, being given a natural amplitude when it meets the core yarn 1.

Figure 4:
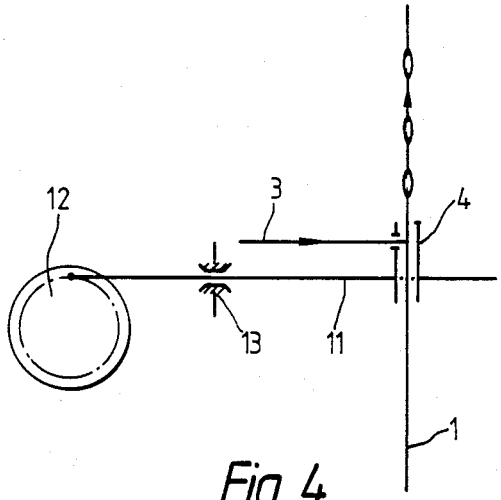
FIG. 4 is an enlarged schematic side elevation of one embodiment of device permitting the oscillation of the effect yarn relative to the core yarn.

FIG. 4 diagrammatically shows one embodiment of a means for controlling the movement of the effect yarn relative to the core yarn 1. It shows the core yarn 1, the effect yarn 3 passing through the guide 4, and a rod 11 connecting the guide 4 to a rotating drive member 12 passing through a fixed point 13.

In operation, referring to FIGS. 1 and 4, the core yarn 1 is fed to delivery rollers 2 of adjustable speed; an effect yarn 3, coming from a support (not shown), passes through the guide 4 mounted on rod 11 and winds around the core yarn 1; the oscillation of the guide 4 caused by the drive member 12 creates nodes of the effect yarn 3 on the core yarn 1, the combination of this oscillation with the increase in twist by the false twist device 6 making it possible to block and stabilize the effects produced.

Referring to FIG. 2, by virtue of the oscillating action of the guide 8 caused by a device similar to that of FIG. 4, the effect yarn 7 creates nodes which are superimposed on those created by the effect yarn 3 on the core yarn 1, the nodes being blocked as before.

In FIG. 3, the effect yarn 3 is not given an amplitude as in the case of FIG. 1 and FIG. 2; its feed is controlled by the rollers 10 and its amplitude is natural by virture of combination with the increase in twist, which takes place in the opposite direction to that of the feed of the core yarn.

The oscillating laying of the effect yarn can be alternate and simple; in this case, part of the movement of the yarn takes place in the direction of the core, while the other part of the movement takes place in the opposite direction. As can be seen in FIG. 4, the rod 11, driven by a rotating plate 12, moves in the fixed slide 13 and permits the raising and lowering, in a direction parallel to that of the movement of the core yarn 1, of the slide 4 through which the effect yarn 3 passes. The raising and lowering speeds of the slide 4 and the amplitude of its movement depend on the profile of the plate and its speed of rotation. If desired, provision can be made to regulate both the raising and lowering speed of the slide and its movement according to non-repetitive cycles, so as to mix up the effects.

As described previously, the use of the false twist device without additional thermal means of stabilization simply allows an alternate twist in the Z-direction and S-direction, which is usually destroyed without additional means; in the present invention the alternation of the Z and S twists with a device such as that of FIG. 4, for example, is such that, without a heat setting oven upstream of the false twist device, the yarns obtained have effects very well bound to the core yarn. This resulting mechanical stabilization is such that the fancy yarn thereby produced can be used as a warp yarn in weaving, without having to be sized as is generally necessary in the case of the use of fancy yarns having looser effects with relative blocking.

If desired, however, it is possible to use a heat treatment meas continuously with the manufacture of the fancy yarn, this heat treatment, situated downstream of the false twist device, serving, for example, either to heat seal one of the yarns used, or to cause shrinkage effects, or the like. In the case where two effect yarns are used, it is also possible to provide a second false twist spindle for the passage of the core yarn between these two yarns.

The fancy yarn is obtained at speeds of between 25 m/minute and 250 m/minute. When two effect yarns are used, the protuberances of the first effect yarn are generally more ordinary than those caused by the second effect yarn, but they can be larger in volume.

The fancy yarn of the present invention be used in weaving or knitting for the production of textile articles intended, for example, for clothing and furnishing.

The examples which follow illustrate the present invention without limiting it.

EXAMPLE 1

A slub yarn of the present Application is produced by means of the process and device illustrated in FIGS. 1 and 4, under the following conditions:

speed of feed of the core yarn: 150 m/minute
speed of feed of the effect yarn: 250 m/minute
speed of the spindle: about 300,000 rpm.

The yarns used have the following characteristics:

core yarn: spun fibres of linear density 70 dtex (50/50 blend of acrylic fibre, cut to a length of 120 mm, and wool).

effect yarn: continuous polyhexamethyleneadipamide yarn of linear density 22 dtex/7 strands—overall linear density: 110 dtex.

winding speed of the fancy yarn: 147 m/minute..

average length of the slub-type protuberances: 5 mm.

EXAMPLE 2

A slub yarn is produced by the process of the present Application using two devices illustrated in FIG. 4, under the following conditions, referring to FIG. 2 or FIG. 3:

speed of feed of the core yarn: 65 m/minute
speed of feed of the 1st effect yarn: 158 m/minute
average speed of the 2nd effect yarn: 100 m/minute
spindle speed: 150,000 rpm
winding speed of the fancy yarn: Z63 m/minute.

The yanrs used have the following characteristics:

core yarn: continuous polyhexamethyleneadipamide yarn: 78 dtex (23 strands)
1st effect yarn: continuous polyhexamethyleneadipamide yarn: 78 dtex (23 strands)
2nd effect yarn: continuous polyhexamethyleneadipamide yarn: 22 dtex (7 strands)
overall linear density: 310 dtex
length of the protuberances caused by the 1st effect yanr: 2 mm
length of the protuberances caused by the 2nd effect yarn: 20 mm.

What is claimed is:

1. A process for the manufacture of a fancy yarn having stable protuberances along its length, said process comprising the steps of feeding a core yarn at a first speed, feeding at least one effect yarn onto the core yarn at a speed greater than said first speed, the effect yarn being fed relative to the core yarn in an oscillating manner, feeding the resulting assembly of the core yarn and the effect yarn without any heat fixing through a single false twist spindle to increase the twist of the assembly, the protuberances produced in the assembly being bound together by the combined action of the oscillating feed of the effect yarn and that of the false twist spindle.

2. A process according to claim 1, wherein the oscillation of the effect yarn is caused by false twisting the assembly of the core and effect yarns in a direction of twist opposite to that of the twist of the core yarn.

3. A process according to claim 1, wherein two effect yarns are fed onto the core yarn, at longitudinally spaced locations, the first and second effect yarns each being fed relative to the core yarn in an oscillating manner, the second effect yarn thereby surrounding the protuberances caused by the first yarn and likewise forming protuberances at points along the assembly.

4. A process according to claim 1, wherein the resulting fancy yarn is wound up at a speed of between 25 and 250 m/minutes.

5. A process for the manufacture of a fancy yarn having stable protuberances along its length, said process comprising the steps of feeding a core yarn at a first speed, feeding at least one effect yarn onto the core yarn at a speed greater than said first speed, the effect yarn being fed relative to the core yarn in an oscillating manner by passing the effect yarn laterally through a guide, through which the core yarn passes longitudinally, the guide being oscillated longitudinally of the core yarn, feeding the resulting assembly of the core yarn and the effect yarn through a single false twist spindle to increase the twist of the assembly, the protuberances produced in the assembly being bound together by the combined action of the oscillating feed of the effect yarn and that of the false twist spindle.

6. The process of claim 5 wherein the amplitude of the oscillation of the effect yarn is varied.

7. A process for the manufacture of a fancy yarn having stable protuberances along its length, said process comprising the steps of feeding a core yarn at a first speed, feeding a first effect yarn onto the core yarn at a speed greater than said first speed, feeding a second effect yarn at a location longitudinally spaced from said first effect yarn onto the core yarn at a speed greater than said first speed, each of the first and second effect yarns being fed relative to the core yarn in an oscillating manner and forming protuberances along the length of the assembly of the core yarn and the two effect yarns, the second effect yarn surrounding the protuberances caused by the first effect yarn, wherein the oscillation of the first effect yarn is casued by false twisting the assembly of the core and effect yarns in a direction of twist opposite to that of the twist of the core yarn, and the oscillation fo the second effect yarn is caused by passing the effect yarn laterally through a guide, through which the core yarn passes longitudinally, the guide being oscillated longitudinally of the core yarn, feeding the resulting assembly of the core yarn and the effect yarns through a single false twist spindle to increase the twist of the assembly, the protuberances produced in the assembly being bound together by the combined action of the oscillating feed of the effect yarns and that of the false twist spindle.

8. The process of claim 7 wherein the oscillation of the second effect yarn is varied.

* * * * *